US005780819A

United States Patent [19]

Fabrikant et al.

[11] Patent Number: 5,780,819

[45] Date of Patent: Jul. 14, 1998

[54] HEATER FOR SHAVING CREAM CONTAINERS WITH DOME-SHAPED SUPPORT AND HEATING SURFACE

[76] Inventors: Marvin Fabrikant; Patricia Fabrikant, both of 5149 Tilden St., NW., Washington, D.C. 20016

[21] Appl. No.: 774,717

[22] Filed: Jan. 3, 1997

Related U.S. Application Data

[63] Continuation of Ser. No. 499,575, Jul. 7, 1995, abandoned.

[51] Int. Cl.[6] ..... H05B 1/00; B67D 5/62

[52] U.S. Cl. ..... 219/535; 219/521; 219/432; 219/433; 222/146.5

[58] Field of Search ..... 219/200, 201, 219/214, 521, 535, 438, 441, 446, 432, 433; 141/82; 392/473–474, 476–477; 222/146.3, 192, 146.5; 248/311.2, 311.3, 346.03, 346.11

[56] References Cited

U.S. PATENT DOCUMENTS

| | | | |
|---|---|---|---|
| 1,650,999 | 11/1927 | Preston | 219/432 |
| 1,827,649 | 10/1931 | Gallipoli | 222/146.3 |
| 3,231,716 | 1/1966 | Van Den Bosch | 219/433 |
| 3,247,360 | 4/1966 | Ponder | 219/441 |
| 3,387,333 | 6/1968 | Irvine et al. | 219/201 |
| 3,432,641 | 3/1969 | Welke | 219/433 |
| 3,454,745 | 7/1969 | Stone | 219/415 |
| 3,578,945 | 5/1971 | Ayres et al. | 219/214 |
| 3,896,973 | 7/1975 | Morgan | 222/146.5 |
| 3,904,086 | 9/1975 | Losenno . | |
| 4,442,343 | 4/1984 | Genuit | 219/433 |
| 5,072,095 | 12/1991 | Hoffmann | 219/432 |
| 5,073,699 | 12/1991 | Box | 219/433 |

*Primary Examiner*—John A. Jeffery
*Attorney, Agent, or Firm*—Foley & Lardner

[57] ABSTRACT

A heater for conventional shaving cream containers is described which includes a dome- or ring-shaped heating element. The ring-shaped heating element can be either a donut-shaped heater that fits around the outer surface at the upper region of the shaving cream container, or it can be a dome or inverted dome-shaped heating element permitting the weight of the container to rest on the heating element.

15 Claims, 5 Drawing Sheets

5
6
12
(THERMOSTAT)
11
(BATTERY)
3

1
2
2
4
5
2
3
6

HEATER FOR SHAVING CREAM CONTAINERS WITH DOME-SHAPED SUPPORT AND HEATING SURFACE

This application is a continuation of application Ser. No. 08/499,575, filed Jul. 7, 1995, abandonded.

BACKGROUND OF THE INVENTION

U.S. Pat. No. 3,454,745 to Stone discloses a heater for shaving lather containers comprising an open-ended cylinder consisting of a housing and liner into which the shaving lather container is placed, the bottom of which has a raised, cube-shaped heating element that imparts heat to the bottom of the shaving lather container by heating the liner.

U.S. Pat. No. 1,827,649 to Gallipoli discloses a device for producing and dispensing lather which integrates a heating element and lather dispenser in one device.

U.S. Pat. No. 3,896,973 to Morgan discloses a device for heating liquid containers, comprising a base with one or more cone-shaped heating elements adapted to fit the bottom of the liquid containers which are placed on top of the heating elements.

SUMMARY OF THE INVENTION

The various devices of the prior art suffer from disadvantages such as lack of mobility, bulkiness, failure to heat shaving cream at the top of the shaving cream container, and inefficient and indirect heating of a shaving cream container resulting in wasted energy. The present inventor undertook to solve these and other problems, resulting in the discovery of an improved device for heating conventional shaving cream containers.

DETAILED DESCRIPTION OF THE PREFERRED EMBODIMENTS

Figures 1, 2:
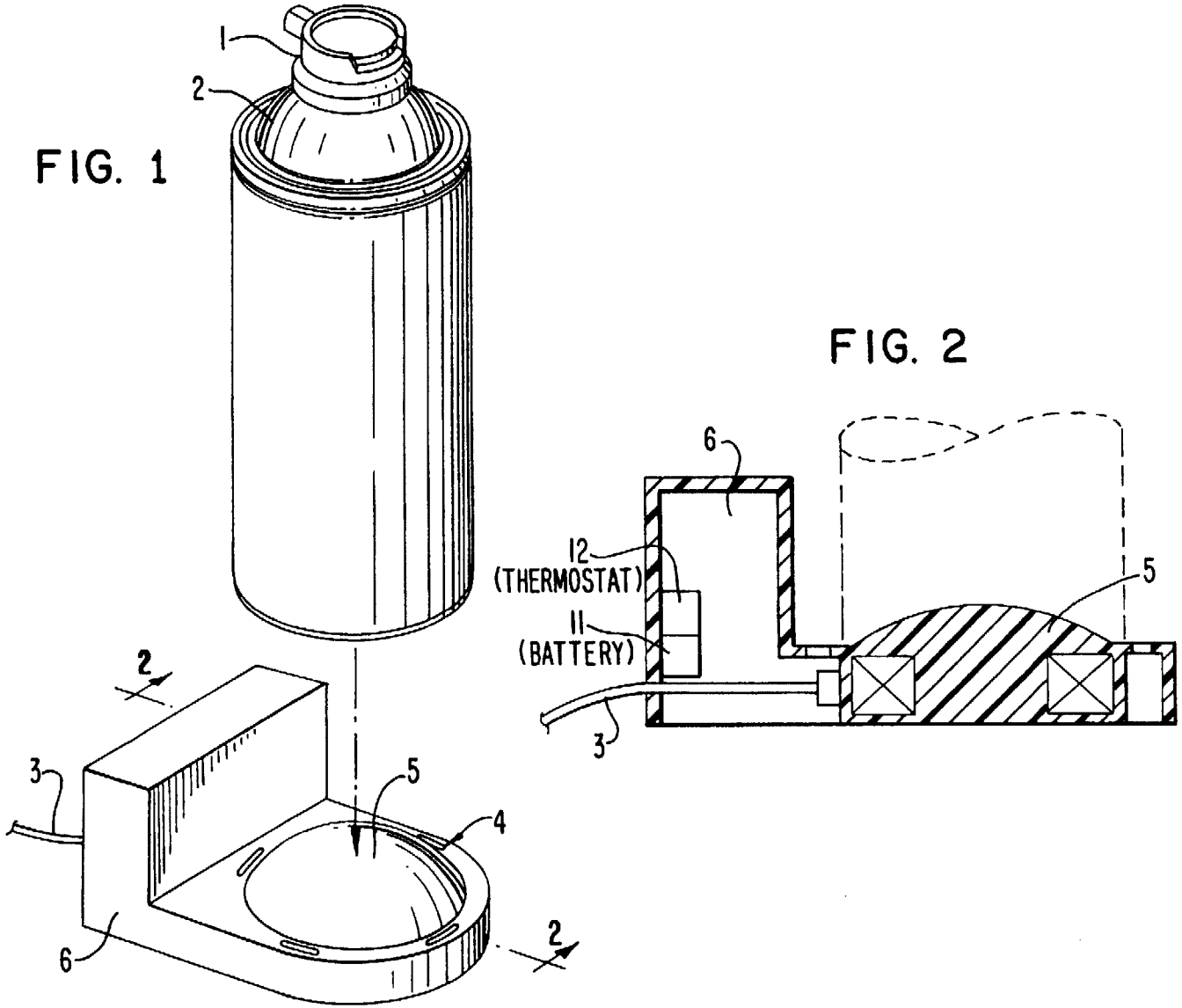
FIG. 1 is a side view of one embodiment of the present invention having a base with a dome-shaped heating element which fits into the bottom of a shaving cream container shown above the dome-shaped heating element.
FIG. 2 is a cross-sectional view of the embodiment of FIG. 1 wherein the shaving cream container is fitted in position to contact the heating element.

In one embodiment, the present invention is directed to a heater for a shaving cream container comprising a base and a dome-shaped heating element mounted in the base, said dome-shaped heating element being shaped to fit into a bottom of a shaving cream container.

In another embodiment, the present invention is directed to a heater for a shaving cream container comprising a base and an inverted dome-shaped heating element mounted in the base, said inverted dome-shaped heating element being shaped to receive a top portion of a shaving cream container.

In another embodiment, the present invention is directed to a heater for a shaving cream container comprising a ring-shaped heating unit with an inner curved heating surface shaped to fit an upper curved section of a shaving cream container and an outer surface insulated from the inner curved heating surface. This embodiment can either be placed around the top of a shaving cream container standing right side up or the heating unit can be turned upside down so that the shaving cream container stands on its head when fitted into the ring-shaped heating unit. Optionally, the ring-shaped heating unit may have a cut-away section for easier placement over the plastic dispensing head of the container. Preferably, the inner surface is made of a metal.

Since the ring-shaped heater is handled by its outer surface and can lose heat to the atmosphere, it is preferable to minimize the heat passing through the outer surface with one or more insulating layers on the outer surface. The outer surface of the ring-shaped housing can be made of the same material as the inner surface, or a different material such as an insulating material. Preferably, the entire ring-shaped housing is made of a metal and the outer surface of the ring-shaped housing is coated with an insulating material, such as ceramics, porcelain or a heat-resistant plastic so as to minimize heating of the outer surface during operation.

The heating elements of the present invention can have a self-contained power supply (such as batteries) or be connected by electrically conductive wire to an external power source (such as a standard wall outlet). A preferred source of electricity is an electrical supply cord having one end adapted to fit a standard electrical wall socket in a house and having a second end connected to the heating element. Another preferred source of electricity is a battery which can be either contained inside the ring-shaped heating unit or base, or which can be mounted on the outside.

The heating element of the present invention can be any conventional heating element including electrical resistance heating elements such as a coiled electrically resistant wire.

Preferably, the heaters of the present invention include means for sensing a shaving cream container which activates the heating element when in contact with the shaving cream container and which turns off the heating element when the heater is not in contact with the shaving cream container. For example, the means for sensing a shaving cream container can be two or more ends of a circuit reaching from the electricity source to the surface of the heating element which contacts the shaving cream container. When the container is present, the circuit is completed and electricity flows through the container to complete the circuit and supply electricity to the means for converting electricity into heat.

Preferably, the heating elements of the present invention also comprise a built-in thermostat for regulating the temperature of the shaving cream container to prevent the shaving cream from exceeding a temperature that would cause the contents of the shaving cream container to rupture the container. The thermostat shuts off the heating element or interrupts the electrical supply to the means for converting electricity into heat when the shaving cream container reaches a temperature below the temperature at which the shaving cream container is caused to rupture. Alternatively, the thermostat can be adjusted by a user to set the temperature at a desired level.

Another embodiment of the present invention is a method of using the heaters of the above embodiments to heat a conventional shaving cream container. The method comprises placing the shaving cream container inside the heater or on top of the dome-shaped heater, either right side up or upside down in the case of the embodiment having a base with a cavity for receiving the dispensing head of the container, causing the heater to heat the shaving cream container, and dispensing the heated shaving cream from the container.

FIG. 1 is a side view of one embodiment of the present invention having a base 6 with a dome-shaped heating element 5 which fits into the bottom of a conventional shaving cream container shown above the dome-shaped heating element 5. The heater includes a power supply cord 3 which connects to the back of the base 6 and connects internally to the heating element 5. The heater optionally includes sensors 4 that sense the presence of the shaving cream container when in contact with the base of the container, completing a circuit with the heating element 5. When the shaving cream container is not present, the circuit is not completed and the supply of electricity to the heating element 5 is shut off. FIG. 1 also shows the shape and features of a conventional shaving cream container, including the plastic dispensing head 1 and the upper curved section 2.

FIG. 2 is a cross-sectional view of the embodiment of FIG. 1 wherein the shaving cream container is fitted in position so that the container contacts the heating element 5 uniformly about the inverted dome-shaped bottom of the container. Optionally, instead of a power supply cord 3, the base 6 may include a self-contained battery 11 for power. In addition, the base 6 may optionally contain a thermostat 12 for regulating the temperature of the shaving cream container.

Figure 3:
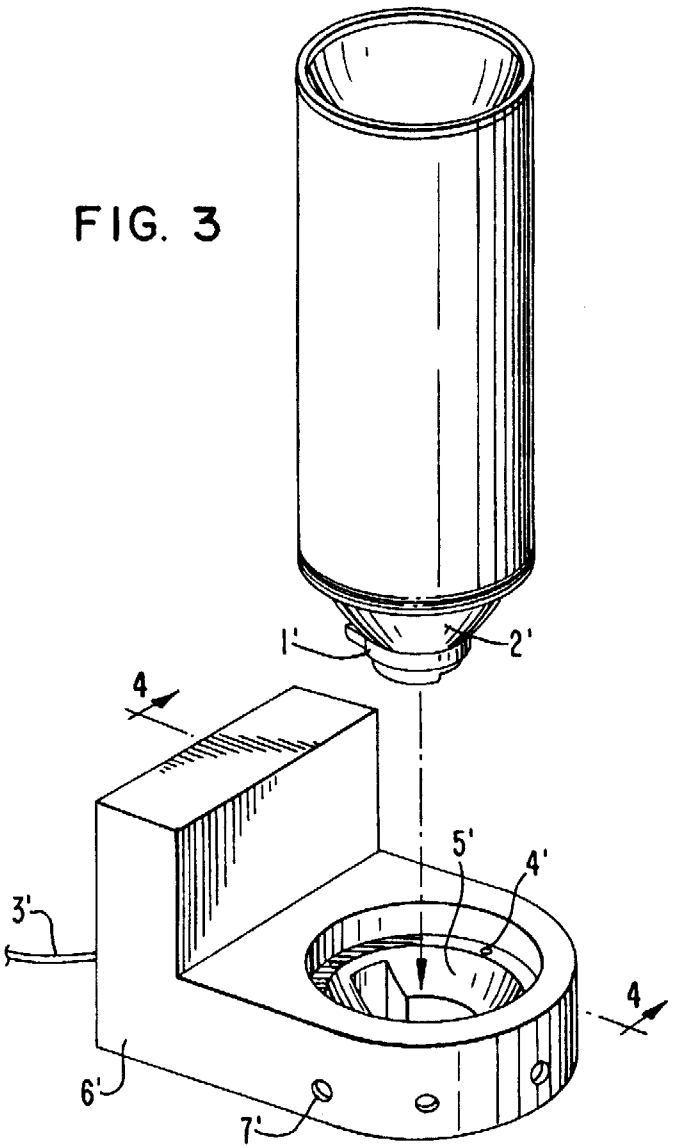
FIG. 3 is a side view of another embodiment of the present invention wherein the base has an inverted dome-shaped heating element that receives the top of a shaving cream container shown above the heating element.

FIG. 3 is a side view of another embodiment of the present invention wherein the base 6' has an inverted dome-shaped heating element 5' that houses and comes into contact with the curved upper metal section 2' of the shaving cream container immediately below the plastic dispensing head 1', the latter of which is not in contact with any heat-producing surface of the heater. The remainder of the shaving cream container stands above the heater as shown in the Figure. The base 6' of the heater optionally includes ventilation holes 7' to prevent heat build-up. A power supply cord 3' connects to the back of the base 6' and supplies electricity to the heating element 5'. Optionally, one or more sensors 4' positioned along a rim above the heating element 5' sense the presence of the container in the same manner described above.

Figure 4:
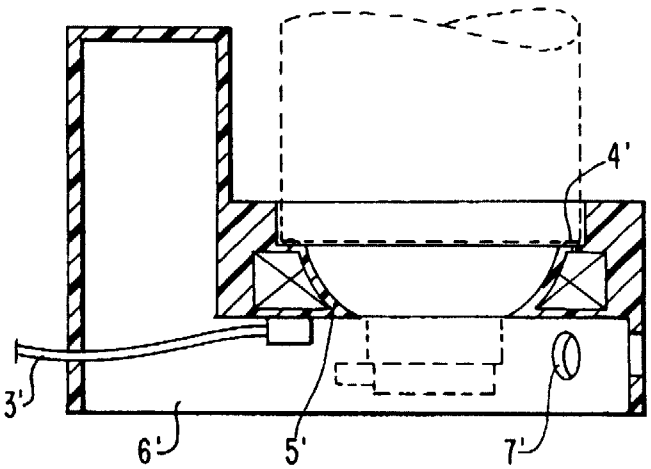
FIG. 4 is a cross-sectional view of the embodiment of FIG. 3 wherein the shaving cream container is fitted in position to contact the heating element.

FIG. 4 is a cross-sectional view of the embodiment of FIG. 3 wherein the shaving cream container is fitted in position to contact the heating element 5' and the plastic dispensing head does not contact any surface of the heater.

Figure 5:
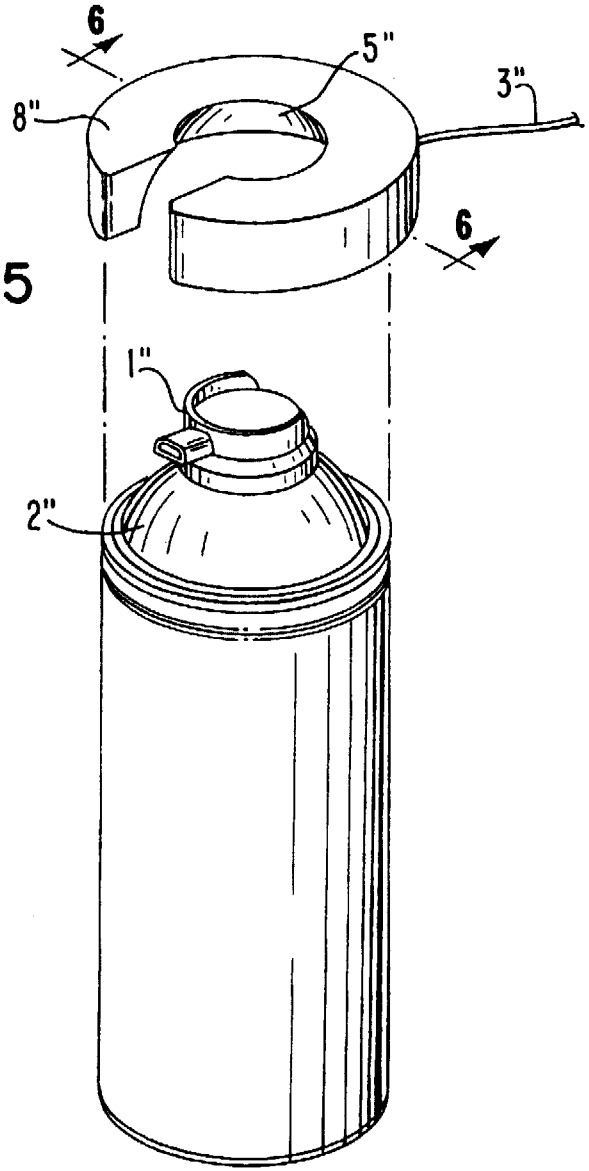
FIG. 5 is a side view of another embodiment of the present invention having a ring-shaped heating element is which encloses the curved upper section of a shaving cream container which is shown below the heating element.

FIG. 5 is a side view of another embodiment of the present invention having a ring-shaped heating unit which encloses the curved upper section 2" of a shaving cream container which is shown below the heating unit. The heating unit includes a curved inner heating surface 5" which contacts the curved upper section 2" of the shaving cream container and a power supply cord 3" which connects to the heating unit through the outer surface 8". The outer surface 8" is heat resistant and preferably insulated from the inner curved heating surface 5" for ease of handling. The shaving dream container has a plastic dispensing head 1".

Figure 6:
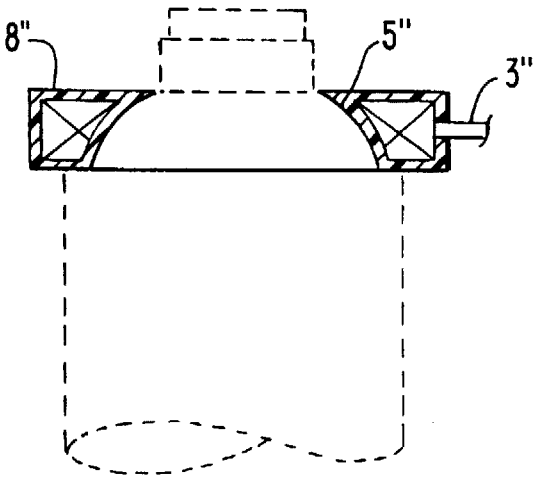
FIG. 6 is a cross-sectional view of the embodiment of FIG. 5 wherein the shaving cream container is fitted in position to contact the heating element.

FIG. 6 is a cross-sectional view of the embodiment of FIG. 5 wherein the shaving cream container is fitted in position to contact the inner curved heating surface 5".

Figure 7:
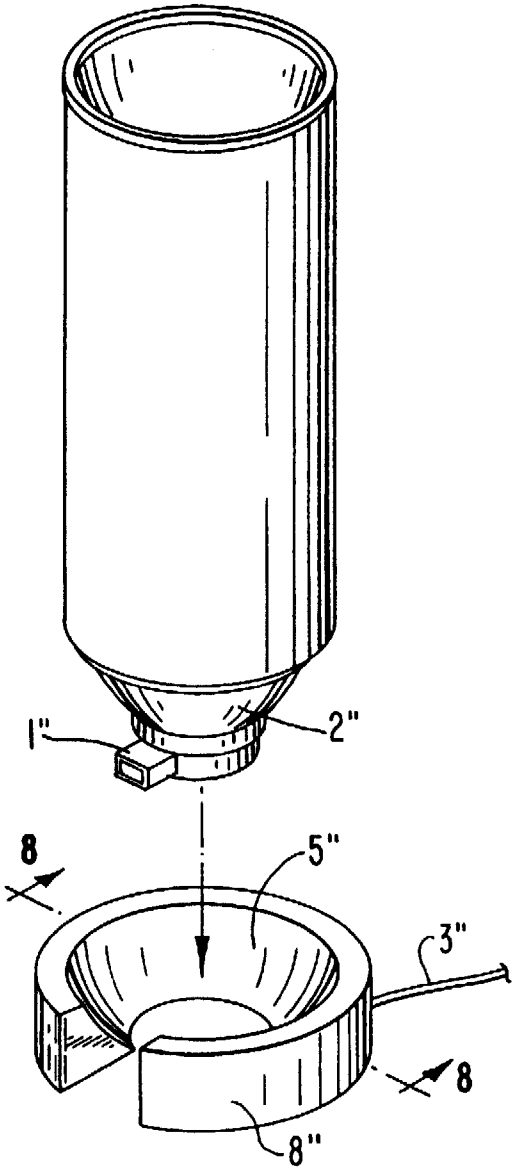
FIG. 7 is the embodiment of FIG. 5 turned upside down with a shaving cream container turned upside down shown above the heating element.

FIG. 7 is the embodiment of FIG. 5 turned upside down with a shaving cream container turned upside down shown above the heating element.

Figure 8:
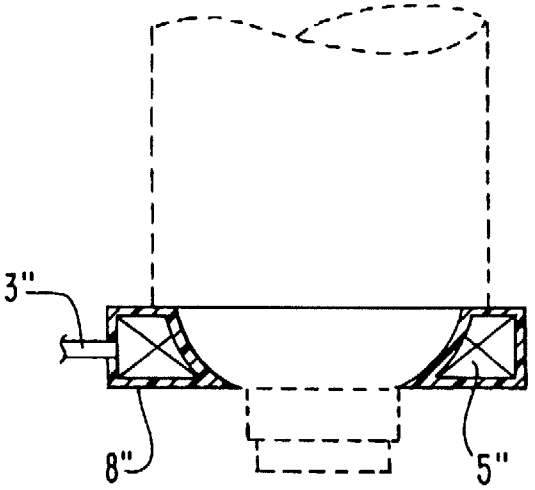
FIG. 8 is a cross-sectional view of the embodiment of FIG. 7 wherein the shaving cream container is fitted in position to contact the heating element.

FIG. 8 is a cross-sectional view of the embodiment of FIG. 7 wherein the shaving cream container is fitted in position to contact the heating element.

Figure 9:
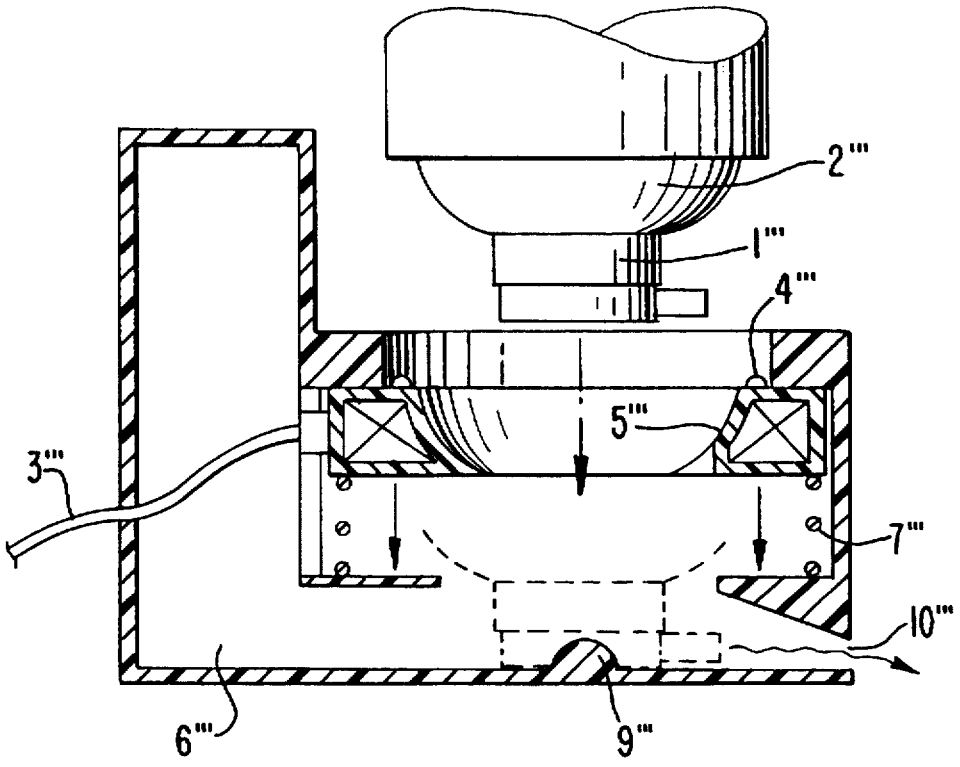
FIG. 9 is another embodiment similar to the embodiment of FIGS. 3 and 4 wherein the inverted dome-shaped heating element is spring-mounted and can be depressed when the shaving cream container shown above the heating element is fitted in position and pushed downward, causing a pin to press the plastic dispensing head and discharge heated shaving cream through a channel in the base.

FIG. 9 is another embodiment similar to the embodiment of FIGS. 3 and 4 wherein the inverted dome-shaped heating element 5'" is spring-mounted and can be depressed when the shaving cream container shown above the heating element 5'" is fitted in position and pushed downward, causing a pin 9'" at the bottom of the base 6'" to press the plastic dispensing head 1'" and discharge shaving cream through a channel 10'" in the base. The shaving cream container pictured above the heating unit has a curved upper section 2'" and a plastic dispensing head 1'". The heater optionally includes a sensor 4'" that senses the presence of the shaving cream container when in contact, completing a circuit with the inverted dome-shaped heating element 5'". The base 6'" optionally includes ventilation holes 7'" to prevent heat build-up. A power supply cord 3'" connects to the heating unit through a back wall of the base 6'".

While the invention has been described in detail and with reference to specific embodiments thereof, it will be apparent to one skilled in the art that various changes and modifications can be made therein without departing from the spirit and scope of the invention.

What is claimed is:

1. A device for heating shaving cream comprising:

(a) a base having a top surface;

(b) a substantially dome-shaped heating element disposed on the top surface of said base; and (c) a shaving cream container containing shaving cream having a non-detachable inverted dome-shaped bottom which contacts substantially all of the substantially dome-shaped heating element to directly pass heat across substantially all of said inverted dome-shaped bottom.

2. The device as claimed in claim 1 further comprising a power supply cord having an end adapted to fit into a 120 V wall socket.

3. The device as claimed in claim 1, wherein said base is composed of heat-resistant plastic.

4. The device as claimed in claim 3, wherein the heating element is coiled electrical resistance wire.

5. The device as claimed in claim 1 further comprising at least one battery disposed within said base.

6. The device as claimed in claim 1 further comprising at least one battery disposed outside said base.

7. The device as claimed in claim 1 further comprising at least one sensor to turn off the heating element when a shaving cream container is not in contact with the heating element and which turns on the heating element when a shaving cream container is in contact with the heating element.

8. The device as claimed in claim 1 wherein the heating element is regulated by a thermostat.

9. The device as claimed in claim 8 wherein the thermostat maintains the heating element at a temperature of about 120° F.

10. The device as claimed in claim 1, wherein the shaving cream container is a conventional shaving cream container.

11. The device as claimed in claim 10, wherein the shaving cream container is metal.

12. A device as claimed in claim 1, wherein the base is substantially wider than a diameter of the shaving cream container.

13. A device as claimed in claim 12, wherein the substantially dome-shaped heating element is fully dome-shaped.

14. A device for heating shaving cream consisting essentially of:

(a) a base having a top surface;

(b) a substantially dome-shaped heating element disposed on the top surface of said base; and (c) a shaving cream container containing shaving cream having a non-detachable inverted dome-shaped bottom which contacts substantially all of the substantially dome-shaped heating element to directly pass heat across substantially all of said inverted dome-shaped bottom.

15. A method of heating shaving cream in a shaving cream container comprising the steps of:

providing (a) a base having a top surface and (b) a substantially dome-shaped heating element disposed on the top surface of said base; and disposing a shaving cream container having a non-detachable inverted dome-shaped bottom over the substantially dome-shaped heating element to heat the shaving cream therein through direct contact between substantially all of the inverted dome-shaped bottom and the substantially dome-shaped heating element.

* * * * *